US010811028B2

(12) United States Patent
Bucher et al.

(10) Patent No.: US 10,811,028 B2
(45) Date of Patent: Oct. 20, 2020

(54) METHOD OF MANAGING ADAPTIVE FEEDBACK CANCELLATION IN HEARING DEVICES AND HEARING DEVICES CONFIGURED TO CARRY OUT SUCH METHOD

(71) Applicant: Sonova AG, Staefa (CH)

(72) Inventors: Samuel Bucher, Rapperswil (CH); Xavier Gigandet, Cousset (CH); Jean-Louis Durrieu, Auenstein (CH); Hannes Wuethrich, Zürich (CH); Markus Hofbauer, Homebrechtikon (CH)

(73) Assignee: Sonova, Staefa (CH)

( * ) Notice: Subject to any disclaimer, the term of this patent is extended or adjusted under 35 U.S.C. 154(b) by 0 days.

(21) Appl. No.: 16/326,936

(22) PCT Filed: Aug. 22, 2016

(86) PCT No.: PCT/EP2016/069768
§ 371 (c)(1),
(2) Date: Feb. 21, 2019

(87) PCT Pub. No.: WO2018/036602
PCT Pub. Date: Mar. 1, 2018

(65) Prior Publication Data

US 2019/0198037 A1 Jun. 27, 2019

(51) Int. Cl.
*G10L 21/0232* (2013.01)
*H04R 25/00* (2006.01)
(Continued)

(52) U.S. Cl.
CPC ..... *G10L 21/0232* (2013.01); *G10L 21/0264* (2013.01); *H04R 3/04* (2013.01);
(Continued)

(58) Field of Classification Search
CPC ..... G10L 21/0232; G10L 21/0264; G10L 2021/02163; H04R 3/04; H04R 25/453;
(Continued)

(56) References Cited

U.S. PATENT DOCUMENTS 8,442,251 B2 * 5/2013 Jensen ..... H04R 25/453 381/312
2002/0064291 A1 * 5/2002 Kates ..... H04R 25/453 381/318
(Continued)

FOREIGN PATENT DOCUMENTS

EP 1228665 B1 5/2003
EP 2360944 A1 8/2011
(Continued)

OTHER PUBLICATIONS

Nakagawa C Renato C et al: "Feedback Cancellation With Probe Shaping Compensation", IEEE Signal Processing Letters, IEEE Service Center, Piscataway, NJ, US, vol. 21., No. 3, Mar. 1, 2014, pp. 365-369, XP011539269, ISSN: 1070-9908, DOI: 10.1109/LSP.2014.2301832.
(Continued)

*Primary Examiner* — William A Jerez Lora

(57) ABSTRACT

This invention relates to a method of managing adaptive feedback cancellation in a hearing device comprising at least a microphone (1); a receiver (2); and a signal processing circuitry, configured to receive from said microphone (1) an input signal ($X_{td}$, $X_{fd}$, $X_c$) and to provide said receiver (2) with an output signal ($Y_{fd}$, $U_{fd}$, $U_{td}$). An external acoustic feedback path (300) defined by feedback sound (fb) traveling from the receiver (2) to the microphone (1) is represented by an external feedback path transfer function (3). The signal processing unit comprises at least a gain unit (4);
(Continued)

a feedback canceller unit (5) comprising an adaptive filter element (6) configured to adaptively accommodate changes in said external acoustic feedback path transfer function (3); and a frequency shift unit (7) configured to stabilize an adaptation of the feedback canceler unit (5). The method according to the present invention comprises the steps of: estimating the external acoustic feedback path transfer function (3) by modeling/deriving a first estimated feedback path transfer function (8) to reflect the external acoustic feedback path transfer function (3), by said feedback canceler unit (5); compensating the input signal of the hearing device ($X_{fd}$), based on the first estimated feedback path transfer function (8), thereby generating a compensated input signal ($X_c$); providing at least part of the signal processing unit with the compensated input signal ($X_c$). The method further comprises the steps of: generating a probe signal (W), by an adaptation control block (9, 10); injecting the probe signal (W) into the output signal ($Y_{fd}$) of the hearing device and letting the probe signal (W) be fed back to the microphone (1) through the external acoustic feedback path (300); modeling/deriving at least a reference estimated feedback path transfer function (11), based on a relation between the input signal ($X_{fd}$) and the probe signal (w); comparing said at least a reference estimated feedback path transfer function (11) with said first estimated feedback path transfer function (8), by a comparison unit (12) of said adaptation control block (9); and controlling the adaptive filter element (6) and the frequency shift unit (7) based on a comparison between such at least a reference estimated feedback path transfer function (11) and the first estimated feedback path transfer function (8).

21 Claims, 1 Drawing Sheet

(51) Int. Cl.
*G10L 21/0264* (2013.01)
*H04R 3/04* (2006.01)
*G10L 21/0216* (2013.01)

(52) U.S. Cl.
CPC .. *H04R 25/453* (2013.01); *G10L 2021/02163* (2013.01); *H04R 25/30* (2013.01); *H04R 25/353* (2013.01); *H04R 25/554* (2013.01); *H04R 2225/41* (2013.01); *H04R 2430/03* (2013.01)

(58) Field of Classification Search
CPC .... H04R 25/30; H04R 25/353; H04R 25/554; H04R 2225/41; H04R 2430/03
USPC ..... 381/71.1, 71.12, 93, 94.1, 94.2
See application file for complete search history.

(56) References Cited

U.S. PATENT DOCUMENTS

| | | | | |
|---|---|---|---|---|
| 2010/0183164 | A1* | 7/2010 | Elmedyb | H04R 25/453 381/71.8 |
| 2015/0063614 | A1* | 3/2015 | Petersen | H04R 25/45 381/318 |

FOREIGN PATENT DOCUMENTS

| | | | |
|---|---|---|---|
| EP | 2613566 | A1 | 7/2013 |
| WO | 01/10170 | A2 | 2/2001 |
| WO | 2006/063624 | A1 | 6/2006 |
| WO | 2007/053896 | A1 | 5/2007 |

OTHER PUBLICATIONS

WIPO, International Search Report, published May 19, 2017, European Patent Office, P.B. 5818 Patentlaan 2, NL-2280 HV Rijswijk.

* cited by examiner

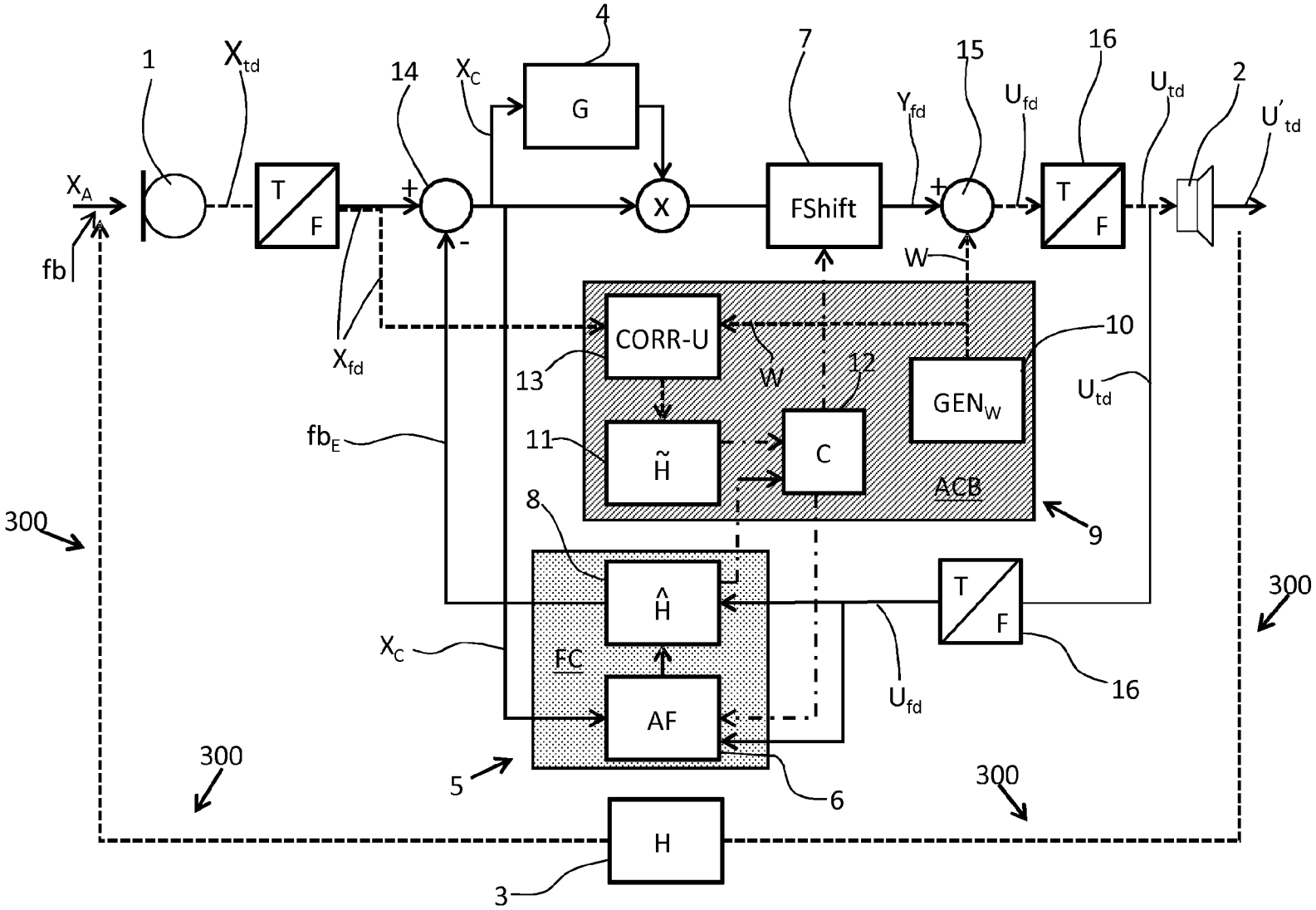
300
U'td
2
Utd
16
T
F
Ufd
15
Yfd
7
FShift
4
G
Xc
14
X
Xtd
1
XA
fb
Xfd
fbE
10
GENW
ACB
9
12
C
W
CORR-U
13
H̃
11
Ufd
16
T
F
6
Ĥ
AF
FC
8
Xc
5
H
3

METHOD OF MANAGING ADAPTIVE FEEDBACK CANCELLATION IN HEARING DEVICES AND HEARING DEVICES CONFIGURED TO CARRY OUT SUCH METHOD

The present invention relates generally to hearing devices and, more specifically, it deals with a method of managing adaptive feedback cancelling in hearing devices, as well as with hearing devices comprising a control system of a feedback cancelling adaptation which operates according to such method.

The present invention, which will be presented in detail in connection with hearing aids, can be arranged to be applied also to other kinds of electronic hearing devices, also to wearable hearing devices, e.g. to media players or similar.

In the context of the present invention, a hearing device is a miniaturized electronic device capable of stimulating a user's hearing and adapted to be worn at (the vicinity of) an ear or at least partially within an ear canal of a user. A primary application of hearing devices is to support and/or improve the individual hearing capacity of hearing impaired users. In such cases, the hearing devices are typically referred to as hearing instruments or hearing aids or hearing prostheses.

Other possible uses of hearing devices pertain, by way of example, to augmenting the hearing of normal hearing persons, for instance by means of noise suppression; to the provision of audio signals originating from remote sources, e.g. within the context of audio communication; and to hearing protection for preventing reception of certain acoustic signals. Hearing devices such as hearing aids can therefore be provided with different types of earpieces for coupling to the ear and/or to the ear canal of a hearing aid user; with earplugs; with headsets or similar.

The electronic devices provided with a feedback cancelling adaptation control system according to the present invention are preferably digital, in that the electronic circuit thereof comprises at least a portion of the components which is digital.

In relation to their application and user indication, and according to the corresponding main solutions available on the market, hearing aids can be worn, for instance, behind the ear (BTE), within the ear (ITE) or completely within the ear canal (CIC). The latest design developments have made available hearing devices that are even smaller than completely within the ear canal (CIC) devices, aptly named invisible in the canal (IIC) hearing aids.

It will be recognized that the inventive features of the present invention are substantially compatible with any style of hearing aids, including the above mentioned models, as well as with hearing aids which are eyewear-mounted, implanted, body-worn, etc.

Hearing aids normally comprise at least one microphone as acoustic input element; at least one loudspeaker—also designatable as receiver—as acoustic output element; and an electronic signal processing circuitry, operatively connected with said microphone and said loudspeaker, for the processing and manipulation of electronic signals. This electronic signal processing circuitry may comprise analogue or digital signal processing devices.

Typically, the microphone acts as an electroacoustic transducer and receives acoustic signals, converts such signals into electrical signals and transmits them to the abovementioned electronic signal processing circuitry.

The electronic signal processing circuitry normally performs various signal processing functions. Such signal processing functions can include amplification, background noise reduction, beamforming, feedback cancelling, frequency lowering, sound type classification, tone control, etc.

Normally, the signal processing circuitry outputs an electrical signal to a loudspeaker. The loudspeaker acts as an electroacoustic transducer and converts the electrical signal from the signal processing circuitry into an acoustic signal which is transmitted as audio into a user's ear. For a cochlea implant, the transducer is replaced by a set of electrodes which deliver electrical impulses directly to the hearing nerve.

The signal processing functions of current hearing aids can be provided with the option of adjustable operational modes or parameters or characteristics, thus allowing user customization of the hearing aids or their prompt adaptive response to given, changeable environment conditions.

In a hearing device, acoustic feedback typically occurs when at least a part of the signal output by the loudspeaker, or receiver, is picked up by the microphone(s), gets amplified in the hearing device and starts to loop around, in a repeated sequence of such cycles wherein the signal level at the microphone(s) ends up being higher than the original incoming signal. Thus, acoustic feedback occurs in connection with a positive loop gain around a feedback loop in which the hearing device output signal comes to affect the input signal; and under the further condition that a forward gain exceeds a leakage attenuation offered by the earmould. Mathematically, the system becomes unstable and the acoustic feedback becomes audible, in the form of an annoying whistling or emission of a howling sound, when the total delay around the entire loop is an integer number of periods of the feedback signal.

Acoustic feedback is more likely to happen when the hearing device volume is increased; or when the hearing device is brought close to a reflecting surface, such as when a mobile phone is brought close to a user's ear; or when sound leaks between an earmould of the hearing device and the walls of the ear canal of a hearing device user, for instance because the hearing device is not properly fitted within the ear canal; or when an especially open fitting is desired and larger vents are employed.

Known suboptimal solutions to acoustic feedback include a generalized gain reduction; or a selective gain reduction at specific frequencies where unstable feedback oscillations are a risk. Alternatively, the use of more sophisticated feedback cancelling algorithms has been proposed aimed at suppressing the adverse effects of the fed-back signal at a hearing device input by estimation of the acoustic feedback path i.e. by the estimation of the transfer function of the acoustic feedback path, from the output of a signal processing circuitry of the hearing device to the input of such signal processing circuitry.

Acoustic paths, such as the ones associated with acoustic feedback, are highly dependent on external variables. In fact, an acoustic feedback path can fluctuate rapidly in response to acoustic environment changes. For instance, when an object such as a phone is brought near a hearing device user's ear, the surrounding acoustic profile is altered and the relative acoustic path is modified. An acoustic feedback can thus increase by several decibels upon moving a telephone handset closer to an ear (or, by way of further examples, when a hearing device user moves closer to a wall or hugs someone or puts on a hat).

It is therefore paramount that feedback path models used in feedback cancelling algorithms account for dynamic changes in the correlated acoustic path, if an effective feedback cancellation is desired. A static feedback canceller cannot accommodate changes in the acoustic feedback path. Accordingly, adaptive feedback canceller systems have been developed which adaptively estimate a current feedback path, typically by adaptive filters or units. Known advanced feedback cancellers comprise adaptive filters which implement adaptive algorithms to obtain an estimated transfer function of an acoustic feedback path. Such adaptive algorithms, for instance Least-Mean-Square algorithms (LMS), continuously, iteratively update the coefficients used by the filter for the estimated transfer function of the acoustic feedback path, so that the estimated transfer function best reflects the transfer function of the actual external feedback path. The more these two transfer functions resemble each other, the more accurate the feedback cancelling action will be. Normally, an estimated transfer function is generated based on the correlation between: i) a so-called error signal, obtained as the difference between a hearing device input signal picked from a microphone and the estimated feedback signal used for feedback compensation; and ii) the hearing device output signal. This is for instance described in EP 2 165 567 B1.

As the above estimation is mainly based on correlating input and output signals of a hearing device, presently available adaptive algorithms for feedback cancellation are sensitive to auto correlated signals: when a conventional feedback canceller is presented with a correlated input signal, recurrent distortion artifacts known as entrainment artifacts are generated, both in personal and public communication electro-acoustic systems.

In order to overcome the issue of entrainment, state-of-the-art hearing aids apply a frequency shift in the amplification path, so that input and output signals are de-correlated and the adaptation of the feedback canceller can be stabilized.

However, frequency shift introduces, in its turn, modulation artifacts which corrupt the sound quality of tonal signals occurring in music as well as in vowel parts of speech.

Various systems have been proposed in the prior art for managing adaptive feedback cancellation in hearing devices in a way that a quick adaptive response is offered to feedback path changes deemed to bring about hearing aid instability and, at the same time, sound quality is not excessively compromised on, that is steady state sinusoidal inputs are not cancelled and the introduction of unpleasant audible processing artifacts and alterations is avoided, also in case of more complex inputs such as music.

In EP 1 228 665 B1, a feedback cancelling system for hearing aids is described comprising means for estimating the condition of the audio signal and means for generating a control signal based upon such condition estimate. A first filter, modelling the quickly varying portion of the hearing aid feedback path, is adaptively updated at least when the condition of the signal indicates that an accurate estimate of physical feedback cannot be made. A second filter, used either for constrained adaptation or to model more slowly varying portions of the feedback path, is updated only when the condition of the signal indicates that an accurate estimate of feedback path can be obtained. Such a signal-dependent adaptation is less than suitable to getting a robust, reliable estimate of a feedback path. This is due to the fact that highly auto-correlated signals would yield non relevant, inconsistent information on the output-to-input forward transfer function of a processing hearing device. This is especially true for periodic signals emitted by musical instruments which will be perfectly correlated with a version of themselves if the time-delay is an integer number of periods.

EP 2 613 567 B1 describes a method of providing a long term estimate of a feedback path of a hearing device. Such long term estimate is derived from stored data of instant feedback path estimates, previously sorted based on a reliability criterion. The reliability criterion is based on detector signals provided by detectors of parameters or properties of the acoustic environment in which the hearing device is operating and/or of signals of the hearing device. The technology used in EP 2 613 567 B1 aims at making dynamic feedback cancellation compatible with a use of a hearing device over time, taking into account long term changes in usage conditions and set-ups and/or in the anatomy of the hearing device user's ear canal. Therefore, the solution proposed by EP 2 613 567 B1 is not particularly suitable to achieve a quick and efficient real-time adjustment of the feedback cancellation functionalities to current changes in the acoustic environment. It also relies on the definition of reliability criteria, so that complicate statistical considerations are implied, with the risk that these may not be adherent to the reality.

Thus, there exists a need for a method of efficiently compensating for an acoustic feedback, in a way that a feedback signal is modeled as precisely as possible to enable a correct feedback compensation, while at the same time the sound quality (especially of tonal components) is improved by keeping to a minimum both entrainment and modulation artifacts.

Accordingly, a major objective of the present invention is to provide an innovative approach to carrying out a targeted feedback cancellation with a fast response to changes in the feedback path.

Another objective of the present invention is to achieve such targeted feedback cancellation without introducing undue complications or subjective rules affected by difficult control or replication in the corresponding algorithm.

These problems are solved through a method of managing an adaptive feedback cancellation in a hearing device, and a correlated hearing device configured to carry out such method, according to the main claims. Dependent claims further introduce particularly advantageous embodiments for such a method and related system.

The inventive solution basically requires selectively implementing adaptive feedback cancellation, by turning off a dynamic, adaptive feedback cancellation whenever it is determined that a current feedback path is substantially static and does not undergo changes. Concurrently, for static situations in which the external feedback path is detected constant over time, the frequency shift function is also preferably turned off. This way, adaptation of the feedback cancellation happens only when it is actually needed and in a way that negative side effects, such as artifacts, are minimized.

Advantageously, the present invention controls an adaptation of a feedback cancellation system in way that memory-intensive calculations (such as iterative coefficient updates in algorithms estimating a feedback path transfer function aimed at modeling the actual, external acoustic path transfer function) are only enabled and implemented when useful. Analogously, an accompanying frequency shifting is implemented only when beneficial.

Moreover, in an acoustic environment which can quickly evolve, the present invention effectively offers an optimal solution to providing a prompt response to changes of a feedback path associated with a hearing device, so that the feedback compensation is best adapted to the current situation.

Other objectives, features and advantages of the present invention will be now described in greater detail with reference to a specific embodiment represented in the attached drawings of FIG. 1, wherein the work-flow underlying the present invention is schematically shown together with a simplified representation of a hearing device designed to work according to such work-flow.

With reference to the exemplifying embodiment of FIG. 1, a hearing device designed to carry out a method of managing an adaptive feedback cancellation according to the present invention comprises a microphone 1; a receiver 2 and a signal processing circuitry, configured to receive from the microphone 1 an input signal and to provide the receiver 2 with an output signal.

In general, in the signal processing circuitry of the hearing device a forward-path transfer function is implemented which defines a relation between the input signal from the microphone 1 to the output signal transmitted to the receiver 2.

The components of an exemplary hearing device functional to the description of the present invention are schematically represented in FIG. 1 in a way that the operative interconnection therebetween is symbolised by lines and arrows. Analogously, the paths followed by respective signals are also synthetically indicated by use of such lines and arrows.

The signal processing circuitry preferably comprises time-to-frequency and frequency-to-time converter units 16, for converting a time frame of digital data from the digital signal into a frequency spectrum having at least one frequency bin, each frequency bin having a power amplitude value and phase value. Thus, signal processing can happen in frequency domain.

Depending on the portion of the path followed by the processed digital signal within the loop represented in FIG. 1; and/or depending on the relative operations executed on the digital signal in a respective path portion, the input signal and the output signal have been denoted by different symbols, as it will be clarified in the following. The input signal has been indicated, at different levels of the forward-path, with symbols $X_{td}$, $X_{fd}$, or $X_c$.

The output signal has been indicated, at different levels of the forward-path, with symbols $Y_{fd}$, $U_{fd}$, $U_{td}$.

The signal emitted by the receiver 2, from which a feedback sound fb may originate, is indicated with $U'_{td}$.

The microphone 1 picks up an actual input signal $X_A$, representing the target input signal which ideally should reach, enhanced, the hearing aid user. However, the microphone 1 may end up picking up also an undesired feedback sound fb. As a consequence, the microphone 1 transmits an overall input signal, comprising both the actual input signal $X_A$ and the feedback sound fb. In time domain such overall input signal is denoted by reference symbol $X_{td}$ in FIG. 1. In frequency domain, the input signal $X_{td}$ is converted to $X_{fd}$.

An external acoustic feedback path 300 is defined by the feedback sound fb traveling, externally to the hearing device, from the receiver 2 to the microphone 1. Together with a forward amplification path followed by a sound signal within the hearing device, the external acoustic feedback path 300 completes a closed loop. Such an external acoustic feedback path 300 can be represented by an external feedback path transfer function 3, also indicated in FIG. 1 by the symbol H for better readability.

The signal processing unit further comprises at least a gain unit 4, aimed at amplifying the input signal in a forward amplification path; and a feedback canceller unit 5, for suppressing the feedback sound fb. In FIG. 1, the gain unit 4 is also denoted with the symbol G.

In the context of the present invention, the feedback canceller unit 5 preferably comprises an adaptive filter element 6, also designated AF in FIG. 1, configured to adaptively accommodate changes in the external acoustic feedback path transfer function 3. The adaptive filter element 6 preferably comprises an adaptation, or update, algorithm.

The signal processing unit also comprises a frequency shift unit 7 configured to stabilize the adaptation of the feedback canceler unit 5 implemented through said adaptive filter element 6. In FIG. 1, the overall feedback canceler unit 5 is also indicated with the symbol FC; whereas the frequency shift unit 7 is also denoted with the symbol FShift.

A method of managing adaptive feedback cancellation according to the present invention comprises a step of estimating, by the feedback canceler unit 5, the external acoustic feedback path transfer function 3 (i.e. H). Such an estimation is achieved by modeling, or deriving, a first estimated feedback path transfer function 8 (also denoted by the symbol $\hat{H}$ in FIG. 1, for readability and with reference to the following formulas) to reflect the external acoustic feedback path transfer function 3. For this purpose, the output signal is brought to the feedback canceler unit 5 to be analyzed. Also the input signal—cleared of the feedback sound in a previous iteration—is brought to the feedback canceler unit 5. Together with the first estimated feedback path transfer function 8, the adaptive filter element 6 forms an adaptive filter. In the embodiment of FIG. 1, the output signal in the form designated with $U_{fd}$ (in the frequency domain, after conversion through a time-to-frequency converter unit 16) is brought to the adaptive filter element 6. A feedback-compensated input signal $X_c$ is also brought to the adaptive filter element 6, wherein the compensated input signal $X_c$ corresponds to the input signal $X_{fd}$, once that a previously estimated feedback sound $fb_E$ has been subtracted, in an iterative calculation process implemented in the algorithm of the adaptive filter element 6. The feedback-compensated input signal $X_c$ is normally designated also as error signal.

Based on the information provided to the feedback canceller unit 5 as above, an updated version of the coefficients of the first estimated feedback transfer function 8 (i.e. $\hat{H}$) is calculated which minimizes the error signal $X_c$.

As already explained, an iterative update of coefficients of the adaptation algorithm implemented in the adaptive filter element 6 lets the first estimated feedback path transfer function 8 (i.e. $\hat{H}$) converge to the external feedback path transfer function 3 (i.e. H). Such algorithm can be, by way of example but not necessarily, a Least-Mean-Square algorithm.

In this way, the first estimated feedback transfer function 8 (i.e. $\hat{H}$) best instantaneously replicates the current external feedback path transfer function 3 (i.e. H) and, at any given time, the estimated feedback signal $fb_E$ which most corresponds to the actual instant value of the current feedback sound fb is derived, for compensation of the input signal $X_{fd}$.

The method according to the present invention comprises, then, the step of compensating the input signal $X_{fd}$ of said hearing device, based on a newly estimated first feedback path transfer function 8. A new compensated input signal $X_c$ is thereby generated, employing signal compensation means 14 which, in the embodiment of FIG. 1, substantially subtracts the newly estimated feedback signal $fb_E$ from the current input signal of said hearing device $X_{fd}$.

The compensated input signal Xc thus generated is then provided to at least a part of the signal processing unit. In FIG. 1, the gain unit 4 applies a gain to the input signal Xc, as symbolized by the "x" sign, thus forming an amplified sound for the benefit of the hearing device user.

The amplified sound can then be fed to the frequency shift unit 7 to control and/or prevent the formation of entrainment-induced artifacts, thereby producing a frequency-shifted output signal indicated by the symbol $Y_{fd}$.

Further to that, the method according to the present invention comprises the step of generating a probe signal W, for instance by signal generating means 10 of an adaptation control block 9 indicated in FIG. 1 with the symbol $GEN_w$. The probe signal W is preferably generated so that it is inaudible to the hearing aid user. The adaptation control block 9 is also designated by the acronym ACB in FIG. 1.

The probe signal W is then injected into the output signal $Y_{fd}$ of the hearing device, by signal injection means 15, and fed back to the microphone 1 through the external acoustic feedback path 300.

After incorporating the probe signal W into the output signal, an output signal is produced in the embodiment of FIG. 1. Preferably, the probe signal W is added in the frequency domain to the output signal denoted with $Y_{fd}$ in the embodiment of FIG. 1, to yield an output signal which is denoted with $U_{fd}$. Such output signal can be converted to a time domain, as symbolized by $U_{td}$, and ultimately be transmitted to the receiver 2, which in its turn emits a signal $U_{td}'$ to the hearing aid user, as illustrated.

The otherwise continuous adaptation of the feedback canceller unit 5 for achieving a precise, punctual compensation of the feedback sound fb—as well as the de-correlation action of the frequency shift unit 7 which preferably accompanies such adaptive process—are controlled by way of the above introduced adaptation control block 9 in the following way.

A gist of the present invention resides in modelling, or deriving, at least one reference estimated feedback path transfer function 11, based on a relation between said input signal and the probe signal W.

In the embodiment of FIG. 1, such a reference estimated feedback path transfer function 11 is also denoted with the symbol $\tilde{H}$.

Modelling, or deriving, the reference estimated feedback path transfer function 11 can be based on a cross-correlation between the input signal and the probe signal W. However, it can also be achieved otherwise, for instance by applying one further adaptive algorithm for the estimation thereof, such as a LMS algorithm.

In the embodiment of FIG. 1, for the estimation of the reference feedback transfer function $\tilde{H}$, the input signal $X_{fd}$ is picked up before the compensation by subtraction of the estimated feedback sound $fb_E$ is carried out, to be cross-correlated with the probe signal W. At any rate, an input signal at some different stage of processing can also be employed, for instance, the compensated input signal $X_c$ can be used.

If the generic symbol X is adopted to symbolise the input signal of the hearing device, then in a preferred embodiment a possible cross-correlation between the probe signal W and the input signal X for deriving the reference estimated feedback path transfer function 11 can be exemplified by the following formula:

$$\tilde{H} = \frac{XW^*}{WW^* + \sigma_n^2}$$

wherein W* is the complex conjugate of the probe signal W and $\rho_n^2$ is a regularization parameter. Additional smoothing factors, such as a low-pass filters of the first order or short time averagers, may be added to the above formula.

The above formula is to be preferably interpreted in the frequency domain. In this sense, if the dependencies from frequency bins k sampled in a frequency-domain representation of respective spectra are highlighted, the above formula takes the following form:

$$\widetilde{H(k)} = \frac{X(k)W(k)^*}{W(k)W(k)^* + \sigma_n^2}$$

In FIG. 1, a cross-correlation unit 13 is represented as a component of the adaptation control block 9 and is also denoted by the symbol CORR-U. The cross-correlation unit 13 preferably incorporates calculating means to model the reference estimated feedback path transfer function 11.

Being derived from the probe signal W, the reference estimated feedback path transfer function 11 (i.e. $\tilde{H}$) is not biased by auto-correlated input signals. Advantageously, time constants to average $\tilde{H}$ can be lower than those used for averaging the estimated feedback path transfer function 8 (i.e. $\hat{H}$). Therefore, a relatively low signal to noise ratio, SNR, of the probe signal W in the input signal X does not adversely affect the estimation of the reference estimated feedback path transfer function 11.

The method according to the present invention further comprises the step of comparing the reference estimated feedback path transfer function 11 with the first estimated feedback path transfer function 8. Such a comparison can be carried out by a comparison unit 12 of the adaptation control block 9 and is substantially aimed at detecting whether a change has occurred in the external acoustic feedback path 300, that is in the relative transfer function 3 (i.e. H).

The method according to the present invention further comprises the step of controlling the adaptive filter element 6 and the frequency shift unit 7, based on the above comparison between said reference estimated feedback path transfer function 11 and the first estimated feedback path transfer function 8.

Preferably, the step of comparing the at least one reference estimated feedback path transfer function 11 with the first estimated feedback path transfer function 8 comprises the step of measuring a difference D between the same reference estimated feedback path transfer function 11 and first estimated feedback path transfer function 8. This measurement operation can be carried out by measuring means incorporated in the comparison unit 12. Such difference D is substantially a measure of how an actual feedback path, represented by the transfer function $\tilde{H}$, is different from the feedback path estimated by the feedback canceler unit 5 and expressed by the transfer function $\hat{H}$. The difference D may substantially take the form of a distance measure between an actual and an estimated feedback path as above indicated. The reference transfer function $\tilde{H}$ is preferably continuously estimated.

The step of controlling the adaptive filter element 6 and the frequency shift unit 7—as it can be achieved by a comparison unit 12—preferably comprises the steps of freezing an adaptation of the feedback canceller unit 5 by deactivating the adaptive filter element 6; and/or deactivating the frequency shift unit 7, when a condition is met that the measured value of the difference D is below a given adaptation threshold value. Preferably, whenever the adaptive filter element is deactivated, concurrently also the frequency shift unit 7 is disabled, so that no modulation artifacts are produced.

Only if the measured value of said difference D is equal or above said given adaptation threshold value, the method according to the present inventions allows adaptation of the feedback canceller unit 5 by activating the adaptive filter element 6 and accordingly activating the frequency shift unit 7.

In fact, if the measured value of the difference D is below the given adaptation threshold value, it is assumed in the present invention that the external acoustic feedback path 300 is substantially static or constant and the compensation of the input signal X can happen in a frozen, non-adaptive mode. As a consequence, entrainment artifacts will not pose a problem and no dedicated remedy will need to be enabled.

In a particular embodiment, the freezing of the adaptation algorithm can be achieved by incrementally decreasing the adaptation rate, i.e. by progressively fading out the step size determining the rate of convergence of the adaptation algorithm, until it becomes zero. By doing so, the accuracy in determining the first estimated feedback path transfer function 8 (i.e. $\hat{H}$) that is employed for compensation in the frozen mode is enhanced.

Instead, if the measured value of the difference D is equal or above the given adaptation threshold value, it is assumed in the present invention that the external acoustic feedback path 300 is substantially undergoing a change and the compensation of said input signal will need to be carried out adaptively. In this case, the system will have to cope with possibly arising entrainment and modulation artifacts, as a trade-off.

In one possible embodiment, the difference D can be reckoned according to a formula as below shown:

$$D = 10 * \log_{10}\left(\frac{\sum |\tilde{H} - \hat{H}|^2}{\sum |\tilde{H}|^2}\right)$$

Emphasizing the dependency on the frequency bins k and summing across such frequency bins k, the above formula can also be written as in the following:

$$D = 10 * \log_{10}\left(\frac{\sum_k |\widetilde{H(k)} - \hat{H}(k)|^2}{\sum_k |\tilde{H}(k)|^2}\right)$$

In a further embodiment, the above formula for the the difference D can be refined to take into account feedback path changes occurring within a narrow band of frequencies as well as the risk of higher variance in the estimation of reference estimated feedback path transfer function 11 and of the first estimated feedback path transfer function 8 for frequency bands with low loop gain. In particular, the difference D between the reference estimated feedback path transfer function 11 and the first estimated feedback path transfer function 8 can be weighted by a loop gain—indicated as $G(k)|\tilde{H}(k)|$ in the following formulas—of said at least a reference estimated feedback path transfer function 11, for each frequency bin k sampled in a frequency-domain representation of a spectrum of the feedback path transfer functions 8, 11; and summed across such frequency bins k.

This weighted—frequency bin-wise—version of the difference D is shown in the formula below:

$$D = 10 * \log_{10}\left(\frac{\sum_k (|\tilde{H}(k) - \hat{H}(k)|^2 G(k)|\tilde{H}(k)|)}{\sum_k |\tilde{H}(k)|^2}\right)$$

A formula modified as above indicated aims at attributing more weight to bins having a loop gain value above and less weight to bins with low loop gain, so that the confidence in an accurate estimate of feedback path transfer functions 8 (i.e. $\hat{H}$) and 11 (i.e. $\tilde{H}$) can be enhanced.

Said given adaptation threshold value for the difference D can be set in a range of values between −15 dB and 5 dB. Preferably, it can be comprised in a range of values between −5 dB and −3 dB.

Together with the above criterion relating to the difference D being above or below a given adaptation threshold value, the control on the turning on or off of the adaptation process of the feedback canceler unit 5 by control means of the comparison unit 12 can also be made dependent on additional criteria.

In this sense, according to a further freeze criterion it can be assumed that, under certain conditions, whistling or howling will not happen, so that an adaptation of the feedback cancelling operations can be frozen and concurrently an associated frequency shift can be disabled. For instance, it can be assumed that an adaptive estimate of the external feedback path 300 can be deactivated whenever control means detect that a maximum loop gain (designatable as $\max(G(k)|\tilde{H}(k)|)$ of said at least a reference estimated feedback path transfer function 11 is equal to or less than a first loop gain threshold for all frequency bins sampled in a frequency domain. Such first loop gain threshold can be comprised in a value range between—40 dB and 0 dB. Preferably, such first loop gain threshold can be set to 0 dB, so that if for all frequency bins k the maximum loop gain is below 0 dB (i.e. it is verified that $\max(G(K)|\tilde{H}(k)|) \leq 0$ dB), the feedback canceler unit 5 can be turned off and the frequency shift unit 7 can be deactivated.

On the other hand, yet an additional un-freeze criterion can be applied in combination with the above freeze criterion, accounting for special cases in which an adaptive feedback compensation is best suited and the above freeze criterion, however verified, would not reflect the current circumstances. In this sense, a third criterion can be conceived to override the two previous criteria, that is the main criterion relating to the measure of a difference D between feedback path transfer functions 8, 11; and the further freeze criterion satisfied whenever maximum loop gain $\max(G(k)|\tilde{H}(k)|$ of said at least a reference estimated feedback path transfer function 11 is equal to or less than a first loop gain threshold.

In fact, in a preferred embodiment, a third criterion is such that adaptation of feedback cancellation can be un-frozen and frequency shift enabled—even under a verified condition that $\max(G(k)|\tilde{H}(k)| \leq 0$ dB—if it is determined that the maximum loop gain $\max(G(k)|\hat{H}(k)|)$, of the first estimated feedback path transfer function 8 is equal to, or larger than, a second loop gain threshold, for all frequency bins sampled in a frequency domain.

By way of example, an adaptation of the feedback canceller unit 5 can be unfrozen and/or said frequency shift unit 7 can be activated, or enabled, whenever it is determined that $\max(G(k)|\hat{H}(k)|)\geq 0$ dB, wherein the second loop gain threshold is here set to zero.

Such third criterion accounts for situations, observed in real time system (RTS) applications, wherein if the real loop gain is changing from overcritical (i.e. >0 dB) to an undercritical situation, while FC is frozen, the first estimated feedback path transfer function 8 (i.e. $\hat{H}(k)$) finds itself compensating for a feedback path that has, in fact, changed. This could cause instability. As the above introduced further freeze criterion (that is, for instance, $\max(G(k)|\tilde{H}(k)|)\leq 0$ dB), would be fulfilled in this case, the system would stay in freeze mode even though a change is being experienced which would ideally require an adaptation thereto. A third criterion as just described therefore advantageously forces an adaptation of the first estimated feedback path transfer function 8 (i.e. $\hat{H}$) for special cases as above presented, overriding the condition on the maximum loop gain of the reference estimated feedback path transfer function 11 which would indicate differently.

The probe signal W allowing the modelling of the reference feedback path transfer function 11 is preferably generated such that it is uncorrelated to the output signal $Y_{fd}$.

The present invention differs from the approaches adopted in the prior art also for the chosen method of generating a multitone-like probe signal W and departs from the common practice of injecting noise signals of some kind, in order to somehow steer the action of feedback cancelling means. Such tone-like probe signal in particular allows to inject more power per frequency bin, without exceeding a given audibility level. This offers the advantage, over a customary noise probe signal, of obtaining a better signal to noise ratio, or SNR, which in its turn results in a lower variance affecting the modelling of the reference feedback path transfer function 11.

Generating the probe signal W according to a specific embodiment of the present invention can comprise the step of providing a frequency-domain representation of an output spectrum (in the following formulas indicated as Y (m, k)) of the output signal $Y_{fd}$ of the hearing device, for a given time frame m, wherein the frequency domain is partitioned in a multiplicity of frequency bins k.

Forming the multitone-like probe signal W preferably further comprises the step of deriving a magnitude |Y (m, k)| of the output spectrum Y (m, k); and then of extracting a magnitude value |Y (m, k)| of such output spectrum Y (m, k) at each of every n-th frequency bin. The symbol n indicates a pre-set multiple index defining pre-set sampling intervals of the frequency domain representation, that is the frequency bins are appropriately selected according to a sequence defined by the multiple index n, for the subsequent calculations. Such multiple index n can be set (depending on overall system parameters such as frequency bin length and hop-size) so that there is no need to introduce time-to-frequency or frequency-to-time transformation units 16 in the adaptation control block 9 where the estimation of the reference feedback path transfer function 11 is implemented. The multiple index can be set for instance to 4, so that in this specific case the following operations will be in fact executed only on the magnitude values |Y (m, k)| of the output spectrum Y (m, k) extracted every 4-th frequency bin.

The generation of the probe signal W can further comprise the steps of scaling down each of the magnitude values |Y (m, k)| by a pre-set scaling factor, denoted by the symbol WRatio; and of multiplying each of said magnitude values by an uncorrelation vector Wkey(k) having unitary amplitude and random phase values.

As already mentioned, the above scaling down operation is functional to making the probe signal W inaudible, or at least less audible, than differently generated noise-like probe signals having equal energy.

The multiplication by an uncorrelation vector Wkey(k) as above defined has the purpose of making the probe signal W uncorrelated with the output signal of the hearing device. Preferably, the random phase values of the uncorrelation vector Wkey remain constant over time, that is between successive time frames. This ultimately results in an injection of a sine tone every n-th frequency bin.

Before being multiplied by the uncorrelation vector Wkey (k), said scaled-down magnitude values (|Y (m, k)| WRatio) can be incremented by a given baseline probe signal power value, designated as WOffset.

It is possible to synthetically represent the above listed steps of generating a probe signal W according to the present invention by the following formula:

$$W(m,k)=(|Y(m,k)|\cdot W\text{Ratio}+W\text{Offset})\cdot W\text{Key}(k)$$

In addition to the above sequence of steps, the generation of the probe signal W can comprise the step of applying a masking pattern (in the following formula denoted by the symbol MaskPattern) to the magnitude values |Y (m, k)| of the output spectrum Y (m, k). This can be obtained by making use of masking thresholds based on the output spectrum Y (m, k) of the output signal $Y_{fd}$ of the hearing device. The masking pattern can apply masking thresholds shaped based on the magnitude values |Y (m, k)| in such a way that, for instance, if a corresponding carrier signal has a loud narrow-band component, audibility thresholds are raised in its neighbouring frequency bands. Such masking thresholds are preferably sound level—and frequency—dependent. As a result of this additional masking effect, the signal to noise ratio of the probe signal W is enhanced, which, as already explained, is advantageous for the estimation of the reference feedback path transfer function 11. The equation below expresses the application of such masking thresholds on the probe signal W:

$$W(m,k)=(\text{MaskPattern}(|Y(m,k)|)\cdot W\text{Ratio}+W\text{Offset})\cdot W\text{Key}(k)$$

Thanks to ability of the present invention to reliably, exactly and promptly discern between cases wherein the external acoustic feedback path 300 is changing or wherein, conversely, such acoustic feedback path remains static, an adaptive compensation of the feedback sound can be applied only when it is actually beneficial and conversely inhibited when it is superfluous. Thus, both entrainment and modulation artifacts can be avoided in situations where typically a feedback path remains substantially unaltered in time, such as when a hearing device user is watching TV, is sitting in a concert hall or similar. As a result, thanks to the present invention, feedback cancelling can be safely activated also for music programs, providing an increased stable gain, while keeping a good level of the sound quality.

Therefore, substantial improvement in sound quality can be foreseen when listening to music or to other highly correlated signals such as ringtones, vowel sounds, etc., compatibly with an efficient compensation of feedback sound.

The invention claimed is:

1. A method of managing adaptive feedback cancellation in a hearing device comprising:

providing an external acoustic feedback path transfer function based on a first estimated feedback path transfer function to reflect the external acoustic feedback path transfer function;

modifying an input signal of the hearing device, based on the first estimated feedback path transfer function, thereby generating a compensated input signal;

generating a probe signal;

injecting the probe signal into an output signal of the hearing device and providing the probe signal to a microphone through an external acoustic feedback path;

deriving a reference estimated feedback path transfer function based on a relation between the input signal and the probe signal;

comparing the reference estimated feedback path transfer function with the first estimated feedback path transfer function; and controlling an adaptive filter unit and a frequency shift unit based on a comparison between the reference estimated feedback path transfer function and the first estimated feedback path transfer function.

2. The method of claim 1, wherein the comparing the reference estimated feedback path transfer function with the first estimated feedback path transfer function comprises measuring a difference between a reference estimated feedback path transfer function and the first estimated feedback path transfer function.

3. The method of claim 1, wherein the controlling the adaptive filter unit and the frequency shift unit comprises:

if the measured value of the difference is below a given adaptation threshold value, freezing an adaptation of a feedback canceller unit by deactivating the adaptive filter unit;

deactivating the frequency shift unit; and only if the measured value of the difference is equal or above the given adaptation threshold value, allowing adaptation of the feedback canceller unit by activating the adaptive filter unit and activating the frequency shift unit.

4. The method of claim 3, wherein the given adaptation threshold value for the difference is between −15 dB and 5 dB.

5. The method of claim 2, wherein if a maximum loop gain of the reference estimated feedback path transfer function is equal to or less than a first loop gain threshold for all frequency bins sampled in a frequency domain, freezing an adaptation of a feedback canceller unit and/or deactivating the frequency shift unit.

6. The method of claim 5, wherein if the maximum loop gain $\max(G(k)|\hat{H}(k)|)$ of the first estimated feedback path transfer function is equal to or larger than a second loop gain threshold for all frequency bins sampled in a frequency domain, unfreezing an adaptation of the feedback canceller unit and/or activating the frequency shift unit.

7. The method of claim 6, wherein the difference between the reference estimated feedback path transfer function and the first estimated feedback path transfer function is weighted by a loop gain $(G(k)|\hat{H}(k)|$ of the reference estimated feedback path transfer function, for each frequency bin k sampled in a frequency-domain representation of a spectrum of the feedback path transfer function; and summed across the frequency bins k.

8. The method of claim 2, wherein the probe signal is generated such that it is uncorrelated to the output signal of the hearing device and/or not audible to a user of the hearing device.

9. The method of claim 8, wherein generating the probe signal comprises:

providing a frequency-domain representation of an output spectrum Y(m, k) of the output signal $Y_{id}$ of the hearing device, for a given time frame m, wherein the frequency domain is partitioned in a multiplicity of frequency bins k;

deriving a magnitude |Y (m, k)| of the output spectrum Y(m, k); and extracting a magnitude value |Y (m, k) | of the output spectrum Y (m, k) by a pre-set multiple index.

10. The method of claim 9, wherein the pre-set multiple index m is equal to 4.

11. The method of claim 10, wherein, before being multiplied by a uncorrelation vector Wkey(k), incrementing scaled-down magnitude values |Y (m, k)|W Ratio) by a given baseline probe signal power value (WOffset).

12. The method of 10, wherein generating the probe signal W comprises applying a masking pattern (MaskPattern) to the magnitude values |Y (m, k)| based on masking thresholds and the output spectrum Y(m, k) of the output signal of the hearing device.

13. The method of claim 2, wherein deriving the reference estimated feedback path transfer function is based on a cross-correlation between the input signal and the probe signal and/or on an additional adaptive filter unit.

14. The method of claim 2, wherein for deriving the reference estimated feedback path transfer function, the input signal is picked up before the compensation at step is carried out.

15. A hearing device comprising:

a microphone;

a receiver;

signal processing circuitry configured to receive from the microphone an input signal and to provide the receiver with an output signal, wherein an external acoustic feedback path defined by feedback sound traveling from the receiver to the microphone is associated with an external feedback path transfer function; and wherein the signal processing circuitry comprises:

a gain unit;

a feedback canceller unit comprising an adaptive filter unit configured to derive a first estimated feedback path transfer function reflecting the external acoustic feedback path transfer function and configured to adaptively accommodate changes in the external acoustic feedback path transfer function;

a frequency shift unit configured to stabilize an adaptation of the feedback canceller unit;

a signal processing unit configured to: modify the input signal of the hearing device, based on the first estimated feedback path transfer function, and to generate a compensated input signal, wherein the signal processing unit further comprises an adaptation control block configured to:

generate a probe signal;

inject the probe signal into the output signal of the hearing device and to enable the probe signal to be fed back to the microphone through the external acoustic feedback path;

calculate a reference estimated feedback path transfer function, based on a relation between the input signal and the probe signal; and a comparison unit configured to compare the reference estimated feedback path transfer function with the first estimated feedback path transfer function and to control the adaptive filter unit and the frequency shift unit based on a comparison there between.

16. The hearing device of claim 15, wherein the comparison unit comprises measuring means configured to measure a difference between the reference estimated feedback path transfer function and the first estimated feedback path transfer function.

17. The hearing device of claim 16, wherein the comparison unit comprises control means of the adaptive filter unit and of the frequency shift unit configured to freeze an adaptation of the feedback canceller unit; and/or to deactivate the frequency shift unit, if a measured value of the difference is below a given adaptation threshold value; and to enable adaptation of the feedback canceller unit and to activate the frequency shift unit, only if the measured value of the difference is equal or above the given adaptation threshold value.

18. The hearing device of 16, wherein a calculating means for modeling the reference estimated feedback path transfer function comprises a cross-correlation unit to correlate the input signal and the probe signal and/or an additional adaptive filter unit.

19. The hearing device of claim 16, comprising means for picking up the input signal for transmission to the calculating means for modeling at last the reference estimated feedback path transfer function before generation of the compensated input signal.

20. A hearing device comprising:

means for receiving an input signal from a microphone;

means for providing a receiver with an output signal, wherein an external acoustic feedback path defined by feedback sound traveling from the receiver to the microphone is associated with an external feedback path transfer function; and a gain unit;

a means for deriving a first estimated feedback path transfer function reflecting the external acoustic feedback path transfer function and configured to adaptively accommodate changes in the external acoustic feedback path transfer function;

a means for stabilizing an adaptation of a feedback canceler unit;

a means for compensating the input signal of the hearing device based on the first estimated feedback path transfer function to generate a compensated input signal;

an adaptation control block comprising:

means for generating a probe signal;

means for injecting the probe signal into the output signal of the hearing device and for enabling the probe signal to be fed back to the microphone through the external acoustic feedback path;

means for modeling at least a reference estimated feedback path transfer function based on a relation between the input signal and the probe signal; and means for comparing the reference estimated feedback path transfer function with the first estimated feedback path transfer function and to control a adaptive filter unit and a frequency shift unit based on a comparison there between.

21. The hearing device of claim 20, wherein the means for comparing comprises means to measure a difference between the reference estimated feedback path transfer function and the first estimated feedback path transfer function.

* * * * *